US011312911B2

(12) United States Patent
Keracik

(10) Patent No.: US 11,312,911 B2
(45) Date of Patent: Apr. 26, 2022

(54) BATCH OIL SHALE PYROLYSIS

(71) Applicant: Charles Sterling Keracik, Willis, TX (US)

(72) Inventor: Charles Sterling Keracik, Willis, TX (US)

( * ) Notice: Subject to any disclaimer, the term of this patent is extended or adjusted under 35 U.S.C. 154(b) by 553 days.

(21) Appl. No.: 14/396,572

(22) PCT Filed: Jan. 3, 2013

(86) PCT No.: PCT/US2013/020119
§ 371 (c)(1),
(2) Date: Oct. 23, 2014

(87) PCT Pub. No.: WO2013/169310
PCT Pub. Date: Nov. 14, 2013

(65) Prior Publication Data

US 2015/0114885 A1 Apr. 30, 2015

Related U.S. Application Data

(60) Provisional application No. 61/645,447, filed on May 10, 2012.

(51) Int. Cl.
*C10G 1/02* (2006.01)

(52) U.S. Cl.
CPC ..... *C10G 1/02* (2013.01)

(58) Field of Classification Search
CPC ..... C10G 1/00; C10G 1/02
See application file for complete search history.

(56) References Cited

U.S. PATENT DOCUMENTS 2,466,593 A * 4/1949 Jones ..... C10G 1/02 201/26
2,581,041 A * 1/1952 Ogorzaly ..... C10G 1/02 201/14
2,723,225 A * 11/1955 Elliott ..... C10G 1/02 201/20
3,567,622 A * 3/1971 Waltrip ..... C10G 1/02 201/20
3,922,215 A 11/1975 Linden et al.
3,960,702 A 6/1976 Allred
4,025,416 A 5/1977 Deering et al.
4,110,193 A * 8/1978 Gwyn ..... C10G 1/02 201/12
4,116,810 A * 9/1978 Jones, Jr. ..... C10G 1/02 201/34
4,210,492 A 7/1980 Roberts
4,778,585 A 10/1988 Graff
4,925,350 A 5/1990 Kolseth
(Continued)

OTHER PUBLICATIONS

International Application No. PCT/US2013/020119 Search Report and Written Opinion dated Apr. 25, 2013, 12 pages.
(Continued)

*Primary Examiner* — Michelle Stein
(74) *Attorney, Agent, or Firm* — Conley Rose, P.C.

(57) ABSTRACT

A cascading reactor system configured for recovering kerogen oil from rubblized oil shale by cycling each reactor through at least a preheating phase, a peak heating phase, a cooling phase, and a recharging phase by the differential and sequential direction of fluid through each reactor and, wherein the system is modularly scalable.

20 Claims, 3 Drawing Sheets

(56) References Cited

U.S. PATENT DOCUMENTS

| | | | |
|---|---|---|---|
| 5,041,210 | A | 8/1991 | Merrill, Jr. et al. |
| 5,071,477 | A | 12/1991 | Thomas et al. |
| 7,955,496 | B2 | 6/2011 | Iqbal |
| 2011/0094940 | A1 | 4/2011 | Weisselberg |
| 2011/0226673 | A1 | 9/2011 | Bilhete |

OTHER PUBLICATIONS

James Bunger, Public Comment, posted on Utah Office of Energy Development website, http://www.energy.utah.gov/government/strategic_plan/docs/publiccomments/jameswbunger10142010.pdf, available at least as early as Dec. 12, 2011, document dated Sep. 20, 2010, 2 pages.

Dyni, J. R., "Geology and Resources of Some World Oil-Shale Deposits," US Geological Survey, Scientific Investigations Report 2005-5294, 2006, 49 pages.

Bartis, J. T. et al., "Oil Shale Development in the United States, Prospects and Policy Issues," Rand Corporation on behalf of the National Energy Technology Laboratory of the US DOE, 2005, 90 pages.

Graham, U. M. et al., "The Fluidized Bed Pyrolysis Characteristics of Moroccan Oil Shale," ACS, Division of Fuel Chemistry, Preprints, 37(2), 1992, pp. 778-784.

Dung, N. V., "Yields and chemical characteristics of products from fluidized bed stream retorting of Condor and Stuart oil shales: effect of pyrolysis temperatures," Fuel, vol. 69, Mar. 1990, pp. 368-376.

Razvigorova, M. et al., "Steam Pyrolysis of Bulgarian Oil Shale Kerogen," Oil Shale, vol. 25, No. 1, 2008, pp. 27-36.

Citiroglu, M. et al., "Fixed Bed Pyrolysis and Hydropyrolysis of an Immature Type I Turkish Oil Shale," Tr. J. of Chemisty, 20, 1996, pp. 175-185.

Birdwell, J. E. et al., "Differentiating Organic Carbon Residues in Spent Oil Shale," 30th Oil Shale Symposium, Colorado School of Mines, Oct. 18-20, 2010, pp. 1-22.

Siskin, M. et al., "Reactivity of Organic Compounds in Superheated Water: General Background," Chem. Rev. 101 (4), 2001, pp. 825-835.

Ekinci, E., "Turkish Oil Shales Potential for Synthetic Crude Oil and Carbon Manufacturing Production," International Conference on Oil Shale: "Recent Trends in Oil Shale", Nov. 7-9, 2006, Amman, Jordan, 19 pages.

* cited by examiner

Heat Transfer from Peak Heating Kettle to Preheating Kettle
*Using Effluent from Peak Heating Kettle*

BATCH OIL SHALE PYROLYSIS

CROSS-REFERENCE TO RELATED APPLICATIONS

This application claims benefit of International patent application Serial No. PCT/US2013/020119 filed Jan. 3, 2013, and entitled "Batch Oil Shale Pyrolysis," which further claims the benefit of U.S. provisional patent application Ser. No. 61/645,447 filed on May 10, 2012, and entitled "Batch Oil Shale Pyrolysis," both of which are hereby incorporated herein by reference in their entirety.

STATEMENT REGARDING FEDERALLY SPONSORED RESEARCH OR DEVELOPMENT

Not applicable.

BACKGROUND

Field of the Disclosure

This disclosure relates enhanced hydrocarbon recovery, specifically to the pyrolytic recovery of kerogen oil from shale.

Background

There has been a renewed interest in unconventional oil and gas development as prices for these products have risen to sustained, record levels. In this context, the easily recoverable oil and gas resources historically have been extracted using conventional off-the-shelf technologies that have been commercially viable for such purposes. However, the easily recoverable oil and gas resources are rapidly diminishing, and thus the more difficult and costly resources remain to be developed. Further, these remaining reserves often found in more remote and dangerous territories.

In some respects, the industry's ability to extract oil and gas bound up in ultra-tight shale appears to provide another potential resource that has not been optimized. By some estimates, there is well over a trillion barrels of oil that may be recoverable from United States shale formations. It should be understood that shale is the source rock from which all of the oil and most of the natural gas produced by the oil and gas industry is derived. Generally, shale is a fine grain, organic rich sedimentary rock, which when subjected to high temperature and pressure during its burial deep within the earth's crust, the organic material is transformed into kerogen, a solid hydrocarbon material which is the precursor of oil and natural gas. With further depth of burial and increase in temperature, the kerogen material is thermally cracked by the natural process of catagenesis, with expulsion of crude oil and natural gas occurring over thousands and millions of years.

These hydrocarbons then migrate vertically and laterally through the earth's crust to become geologically trapped in subsurface structures and other stratigraphic traps and these are the oil and gas reservoirs that have been historically developed by the industry. In the case of the new oil and gas shale plays that are currently being exploited, the oil and gas is being produced from the shale. Many shale formations outcrop at the surface and often have not been buried deep enough in the Earth's crust during their geologic history for catagenesis to occur. In the US and many other countries there is an abundance of oil shale outcropping at the surface, or within easy reach just beneath it using conventional excavation and recovery technologies. Outcropping shale formations account for 20% of the surface area in the US. Thus, with extraction of oil from these organic rich shale rocks, it may be estimated that, for example, the US would have a nearly inexhaustible supply of kerogen derived liquid fuel.

One technological impediment to the development of a surface mineable oil shale industry has been the relatively poor quality of man-made kerogen oils. These oils tend to contain more olefinic hydrocarbon species which can cause gumming when exposed to oxygen, and these oils tend to have a lower hydrogen-carbon ratio and consequently lower American Petroleum Institute (API) gravity. Versus West Texas Intermediate having approximately 40 API gravity, some oil shale technologies produce oils with gravities at or below approximately 20 API gravity. Further, kerogen oils tend to be much richer in nitrogen, chlorine, arsenic, and other contaminants, often by orders of magnitude relative to crude oil. Many of these constituents serve as catalyst poisons which prevent the kerogen oils from being directly blended into the crude oil feedstock of current refineries. Since the refining industry has been built around the processing of more conventional crude oils which don't possess these characteristics, further investment in upgrading via hydro-treating is needed to process kerogen oils into more fungible syncrudes capable of being blended.

The biggest economic impediment to the development of oil shale in the 1970s/80s was the cost to mine and crush oil shale. Approximately two tons of Green River oil shale with an assay of 21 gallons-per-ton is required to make one barrel of oil. In 1983, when the price of oil was $29/barrel the surface mining cost was approximately $13/ton or $26/barrel. Mining costs alone consumed over 90% of the sales price of a barrel, leaving little room for other costs to process and transport the oil, leaving no room for any profit. With improvements in surface mining efficiency over the past 30 years, the cost to mine a ton of shale has fallen to below $10/ton or $20/barrel, while the price of oil has escalated to approximately $100/barrel, thus expanding the operating margin to $80/barrel before consideration of other costs and improving the outlook for a healthy profit margin.

The most widely used process technologies to extract kerogen oil from shale involve the heating of oil shale particles via pyrolysis, a higher temperature and therefore more rapid means of breaking down solid kerogen into oil and gas as compared to natural catagenesis. Pyrolysis can achieve in a matter of minutes or seconds an outcome similar to what it takes nature thousands or millions of years to achieve. Currently, the industry has directed most of its R&D investment into a class of technologies which require the partial combustion of the shale particles to provide the heat necessary for pyrolysis. In these processes, the carbon residue that remains behind in the spent shale particles is used as a fuel source for heating. These processes typically use hot combustion gases, the combusted shale particles themselves or other solid materials heated by the combustion of shale particles to heat raw shale to pyrolysis temperatures. These are typically continuous processes whereby a stream of hot gases or solids is flowed countercurrent to the direction of incoming raw shale. There are many environmental issues which arise from combustion processes, in addition to other operational problems. Further combustion type processes typically suffer from reduced yield versus Fischer Assay and typically produce lower API gravity kerogen oil. Today, most kerogen oil production, approximately 20,000 barrels per day in China, Estonia and Brazil, is derived from combustion processes, most of which is deemed sub-economic and/or uncompetitive with conventional oil and gas development.

Thus there is a need for new methods to economically extract high quality kerogen oil from organic rich shale that can be undertaken in an environmentally respectful manner.

BRIEF SUMMARY

In one configuration there is disclosed herein a thermally efficient, cascading reactor system configured for recovering kerogen oil from rubblized oil shale by cycling each reactor through at least a preheating phase, a peak heating phase, a cooling phase, and a recharging phase by the differential and sequential direction of fluid through each reactor and, wherein the system is modularly scalable.

In another configuration the present disclosure may be considered a mechanically simple and thermally efficient batch process for recovering kerogen oil and other gaseous products from organic rich shale rock via aqueous pyrolysis is disclosed herein. The process involves a prescribed sequence of heating and cooling cycles applied to reusable fixed bed reactor reactors charged with shale rubble. The system and method herein is configured for multiple reactor commercial application, whereby separate reactors operating concurrently at different stages of heating and cooling can achieve significant thermal efficiency. As an aqueous fluid is the primary medium for heating and cooling of the reactors, heat transfer is achieved by circulating liquid water, steam, or both between reactors that are operating at different temperatures. With multiple reactors in operation, a near uniform kerogen oil and gas production rate can be maintained.

Alternatively, there is disclosed a system for recovering a hydrocarbon from oil shale comprising, a plurality of reactors in fluid and thermal communication, a plurality of conduits for conveying a fluid between each reactor, and at least one product conduit for withdrawing the condensed liquid at temperature. In this configuration, the reactors are arranged in a thermal cascade, such that the thermal effluent from the hottest reactor is introduced to the next hottest reactor, from a first reactor to a last reactor, wherein the last reactor is the coolest reactor. Further, the reactors are arranged in a liquid cascade, such that the condensed liquid from the thermal effluent is collected after each respective reactor from a first reactor to a last reactor. Additionally, there is at least one conduit in thermal communication with a reactor configured to reduce the temperature therein and wherein the at least one conduit is thermal communication with at least one other liquid conduit in order to provide thermal energy for heating the last reactor.

In still further configurations of the presently disclosed system, each reactor comprises a vessel extending from a cap to a base having a thermal insulation located on either the interior or exterior of the vessel between the cap and the base, a perforated distributor plate disposed is at the bottom of the reactor to support particulate reactor contents that have a dimension of at least about 3" and to permit a gas flow therethrough. Disposed therein below is a chute having a means to convey solid materials from the reactor, and an injector in fluid communication with the chute and the reactor via the perforated plate. Also, in the present configuration there may be a plurality of conduits in fluid communication with the reactor via at least one of the cap and the injector.

The system configured thusly may be used according to a method for recovering kerogen oil comprising loading a first and second reactor with rubblized oil shale, heating the first reactor to a first peak heating temperature with steam or water while heating the second reactor to a preheating temperature with the hydrocarbon vapor from the first reactor. The method includes collecting condensate from the second reactor, heating the second reactor to a second peak heating temperature with steam or water, cooling the first and second reactor and removing spent rubblized shale therefrom and recovering kerogen oil from the collected condensate.

In another operation the method for recovering hydrocarbons from oil shale, comprises operating multiple reactors in a batch mode, wherein the reactors are configured for aqueous hydrolysis by charging each reactor with oil shale particles having a maximum dimension of 6 inches. Subsequently, cycling each reactor to undergo in a batch cycle comprising at least once of each of the phases including a preheating phase, a peak heating phase, a cooling phase, and a recharge phase. The method also comprises operating all reactors concurrently, such that no reactor is in the same operating phase simultaneously, recovering heat energy from at least one hot reactor upon completion of the peak heating phase, and transferring the heat energy to at least one cooler reactor operating in the preheating phase.

The foregoing has outlined rather broadly the features of the disclosure in order that the detailed description of exemplary embodiments of the invention that follows may be better understood. Additional features and characteristics of exemplary embodiments will be described hereinafter. Thus, embodiments described herein comprise a combination of features and characteristics intended to address various shortcomings associated with certain prior systems and methods. The various characteristics and features described above, as well as others, will be readily apparent to those skilled in the art upon reading the following detailed description of the exemplary embodiments, and by referring to the accompanying drawings.

BRIEF DESCRIPTION OF THE DRAWINGS

For a detailed description of the disclosed exemplary embodiments of the invention, reference will now be made to the accompanying drawings in which.

NOTATION AND NOMENCLATURE

Figure 1:
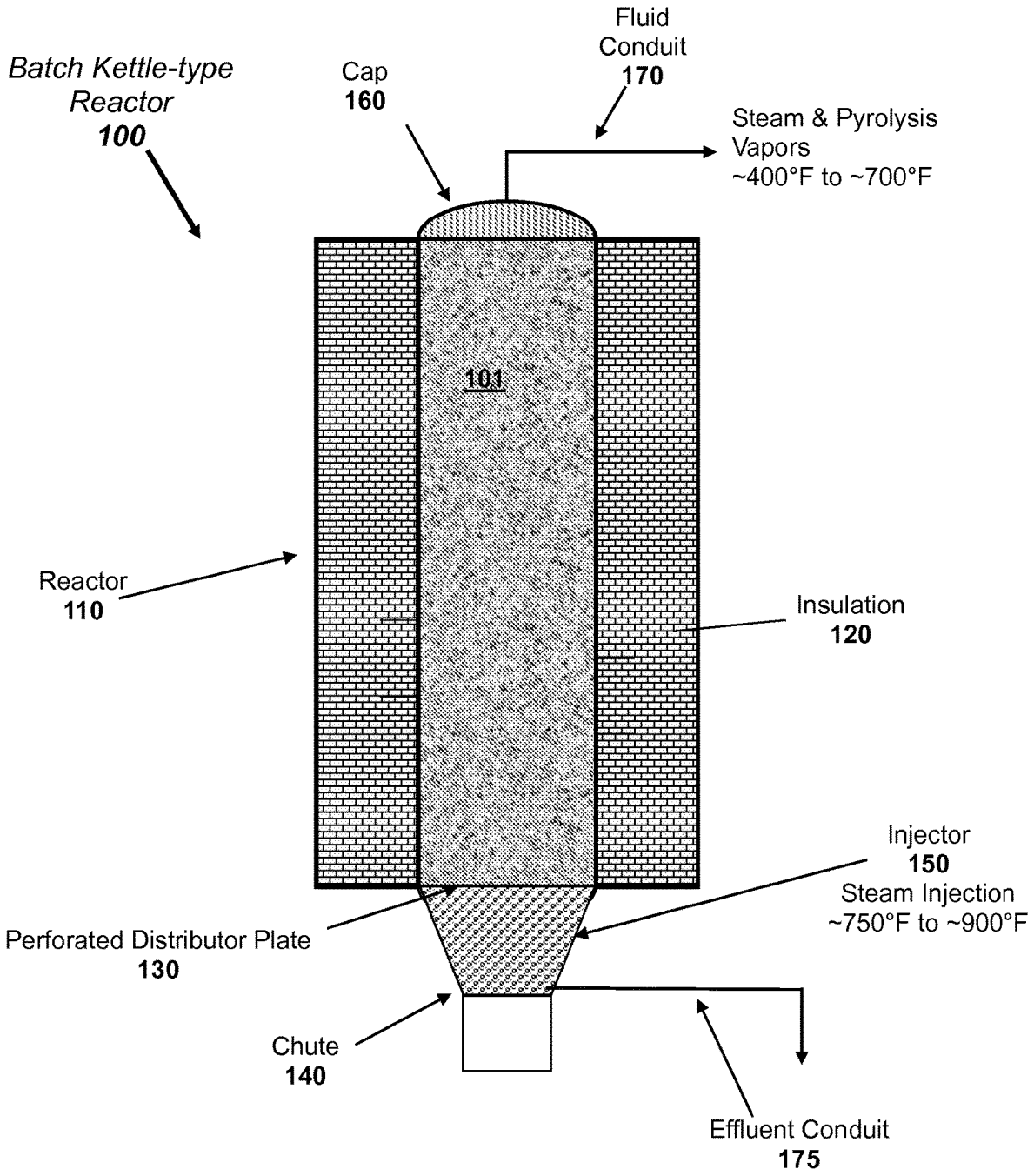
FIG. 1 schematically illustrates a batch process reactor configuration according to the disclosure.

In the following discussion and in the claims, the terms "including" and "comprising" are used in an open-ended fashion, and thus should be interpreted to mean "including, but not limited to . . . ".

Also, the term "couple" or "couples" is intended to mean either an indirect or direct connection. Thus, if a first device couples to a second device, that connection may be through a direct connection of the two devices, or through an indirect connection as accomplished via other intermediate devices, apparatuses, and connections.

The term "vessel" is used herein to refer to containers used for heating or cooling shale particles. As found herein, the term "kettle" may be used interchangeably with the term "vessel". Further, "kettle" is intended to more specifically refer to a vessel configured for batch processing a finite quantity of shale. Still further, "retort" is used herein to refer to a vessel configured for high-temperature pyrolysis.

"Rubblization" refers to the fragmentation of rock by mechanical means to achieve smaller sized particles. Further, the term "rubblized" refers to material that has been mechanically fragmented to smaller sized particles.

"Aqueous pyrolysis" or "hydrous pyrolysis" refers to the thermal decomposition of organic compounds brought about at high temperature in the presence of water, which exists either in the form of liquid water or vapor/steam.

As found herein "hydrocarbon species" refers to the numerous hydrocarbon compounds of differing physical properties which have been generated by pyrolysis reactions.

The term "saturated steam" refers to steam that is in equilibrium with heated water at the same pressure.

Further, the term "superheated steam" refers to steam that is elevated in temperature above its saturation temperature.

As used herein "lean gas" or "lean hydrocarbon species" refers to low molecular weight hydrocarbon species remaining in the gas phase after high molecular weight hydrocarbon species have been condensed.

DETAILED DESCRIPTION

Overview:

The system and method to be described is focused on a design for a mechanically simple technology to enable a rapid ramp up in kerogen oil production volumes such that scale efficiencies may be realized. In a departure from the typical continuous processing retorts that underpin many oil shale technologies, a form of batch processing using aqueous (hydrous) pyrolysis is being advocated. While this is a batch process, multiple batches are undertaken in assembly line or sequential fashion to produce a near continuous production rate of a refinable kerogen oil product.

Certain properties arise from the use of aqueous pyrolysis. As a heat transfer medium, steam and/or water may be used to both heat and cool batches of shale rapidly through direct or indirect means. Further, the use of an aqueous medium provides a highly efficient means for recovering heat and transferring it between batches of shale. Additionally, pyrolysis undertaken in the presence of water appears to be beneficial in improving kerogen oil yield, approaching or exceeding the yield derived by the Fischer Assay method. Without limitation by theory, this may be due to the incorporation of exogenous hydrogen into various the hydrocarbon species and this hydrogen can only be sourced from the water in contact with the shale during pyrolysis. Further, as disclosed herein by elevating the temperature of kerogen rich shale to the thermal window between about 300° F. and about 1000° F., a virtually complete pyrolysis of the shale will occur to create man-made kerogen oil.

The embodiments disclosed herein are designed and operated to be as a simple batch design. Multiple reactors are contemplated, each operating in a different heating or cooling phase. The temperature differences that exist between the reactors, creates the opportunity to achieve high thermal efficiency by transferring heat from a hotter reactor(s) to a cooler reactor(s). As disclosed herein, an aqueous fluid is used as the primary heating medium, thus permitting the extraction of kerogen oil from organic rich oil shale rock obtained from either a surface or subsurface mining operation, in a mechanically simple system.

Method:

In general, rubblization enhances the surface area of the shale available for heat transfer, while also yielding a particle size distribution which preserves highly permeable flow paths for injected aqueous fluid contacting the shale particles. The process comprises heating of oil shale rubble by an aqueous fluid to temperatures necessary for the conversion of the solid kerogen into gaseous and liquid hydrocarbon species via aqueous pyrolysis; as used herein the molecular cracking in the presence of water, primarily in the thermal window from about 300° F. to about 1000° F.; alternatively from about 350° F. to about 950° F.; and still further from about 400° F. to about 900° F. The peak temperature and temperature range to be applied may be dependent upon the properties of particular shale used, and other design considerations in an economically optimal process installation. Heating is achieved by direct injection of aqueous fluid, water or steam, into a heavily insulated fixed bed reactor, such as a kettle or retort, which has been charged with rubblized oil shale particles. In certain instances the rubblized shale is dimensionally less than about 6 inches in any one dimension; alternatively less than about 5 inches and in certain instances, less than about 3 inches in any one dimension. In still further instances, the rubblized shale may be dimensionally less than about an inch in any dimension.

FIG. 1 illustrates an exemplary batch kettle system 100 for the peak heating period. Generally the batch kettle system comprises a kettle or reactor 110 surrounded by an insulation 120. Insulation 120 maybe any known insulator without limitation that is configurable to withstand, buffer, or retain reactor heat and may be placed on either the interior of the kettle or exterior as shown. In certain instances, the insulation 120 may comprise a solid structure and alternative, the insulation 120 may comprise a fluid conduit or jacket, such as a gas or liquid jacket. In some configurations the reactor 110 and the insulation are configured to operate at any temperature below the peak heating temperature of the reactor 110 of less than about 2000° F.; in some configurations less than about 1500° F., and in further configurations less than about 1000° F. Reactor contents 101 are removably retained within the reactor 110. The reactor 110 includes a perforated distributor plate 130 that forms the bottom or base thereof. Without limitation by theory, the perforated distributor plate 130 comprises a holed or screened support for the reactor contents 101. Disposed below the perforated distributor plate 130 is a chute 140 for directing and conveying reactor contents 101 out of reactor 110. Perforated distributor plate 130 may be moveable or repositionable to permit emptying of reactor 110 via chute 140. In certain instances, chute 140 includes an injector 150 and an effluent conduit 175. Injector 150 is any injector that is configurable to inject fluid, vapors, steam, or other superheated gases into the chute 140. Effluent conduit 175 is any conduit for the retrieval and conveyance of fluids from the reactor 110. Further, chute 140 comprises a valve, hatch, or other sealable passage therethrough such that pressures and temperatures are retained in the reactor 110.

The reactor 110 includes a cap 160 configured to fluidly connect fluid conduits 170 to the reactor contents 101. In configurations, the cap 160 is coupled to a plurality of fluid conduits 170 configured to entrain and convey fluids, including vapors, gases and liquids from the reactor 110. In further configurations, certain fluid conduits 170 in the cap 160 provide a fluid flow into the reactor 110, for example in direct contact with the reactor contents 101. Further, it may be understood that cap 160 is pivotable or removable to permit solids depositing into reactor 110 in order to form and/maintain reactor contents 101. Still further, cap 160 may comprise a hatch or other sealable passage therethrough for the same purpose.

Without limitation by theory, the injector 150 injects steam or superheated gases into the reactor 110 via the chute 140 and the perforated distributor plate 130. In some configurations the injector 150 is configured to inject any fluid into the chute 140 and the reactor 110. The steam or vapor from fluid travels vertically through the reactor contents 101 to contact cap 160. Cap 160 directs gases into fluid conduits 170 for direction to other reactors for additionally processing or distillation to form reactor products. Further, cap 160 directs fluids from fluid conduits 170 into the reactor contents. Generally, reactor products may be considered refinable hydrocarbons, in certain instances may comprise hydrocarbon liquids, and more specifically kerogen oils as discussed herein.

During what is referred to herein as the "peak heating phase" or "peak heating period" heat transfer from the aqueous fluid to the shale rubble occurs in the thermal window from about from about 300° F. to about 1000° F.; alternatively from about 350° F. to about 950° F.; and still further from about 400° F. to about 900° F. as illustrated in FIG. 1. The fluid is injected at a temperature in excess of about 750° F. into the reactor contents 101, comprising rubblized shale which has already been pre-heated to about 400° F. In some configurations, the steam enters through a perforated distributor plate 130 located in the bottom of the reactor 110. As the steam moves vertically through the reactor 110, the temperature of the steam declines as its heat is transferred to contacted oil shale particles in the rubblized shale. Steam-to-shale heat transfer occurs by convection as the steam flows between the shale particles, whereas for steam flowing within the shale particles the heat transfer is by conduction.

The reactor is charged with shale rubble so as to have a void space from about 10% to about 50%; further from about 18% to about 45%; and alternatively, from about 25% to about 40%. The void space is at least partially dependent upon particle size distribution of the shale rubble introduced into a reactor and is a design consideration which may vary between particular projects. As may be understood, particle size will affect the rate of heat transfer as well as the permeability of the rubblized shale bed, thus the flow rates that can be achieved through the bed.

Figure 2:
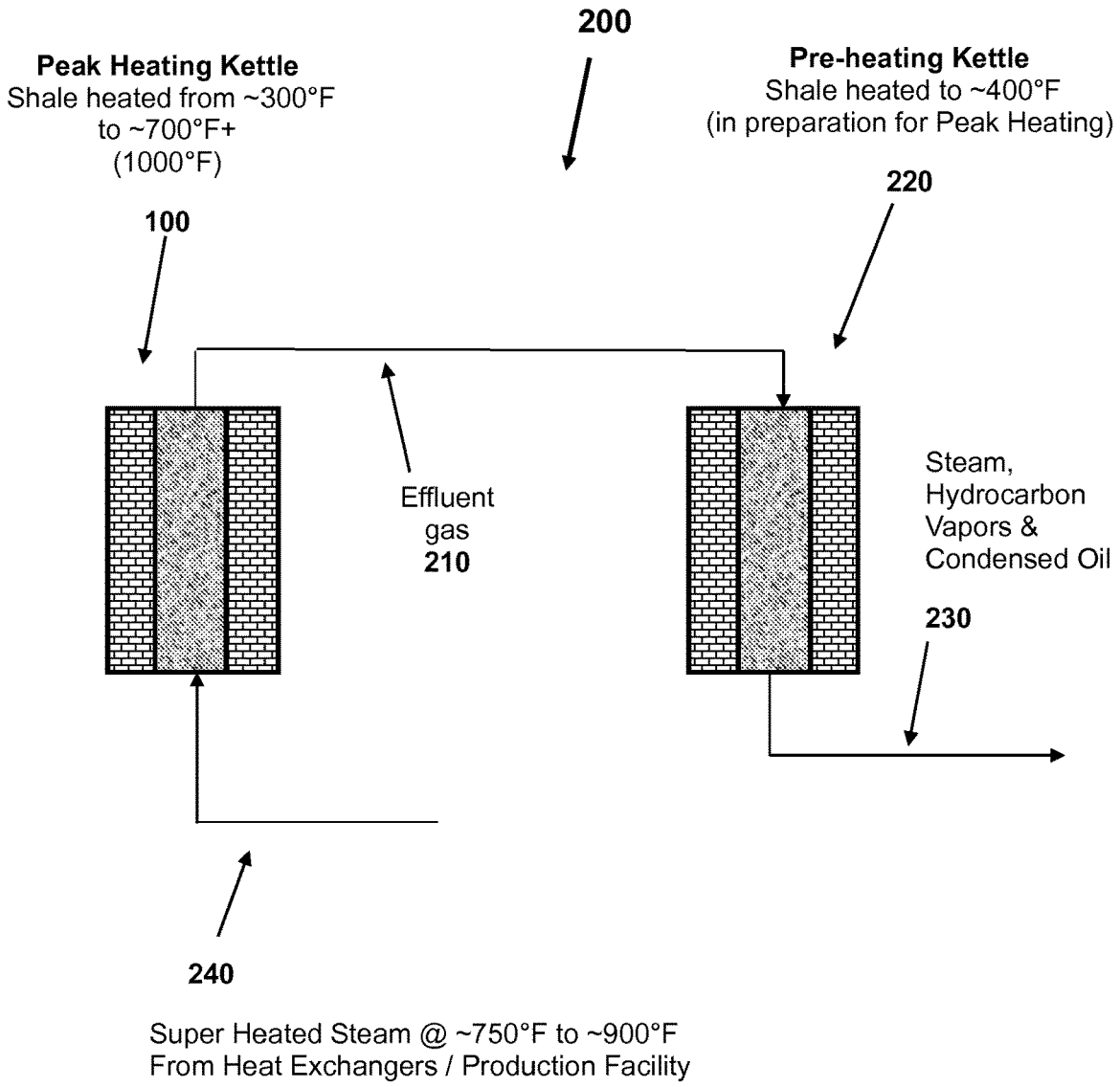
FIG. 2 schematically illustrates a batch process system configuration according to the disclosure.

Referring now to FIG. 2, hydrocarbon species created from pyrolysis reactions with boiling points below approximately 700° F. may be vaporized during the peak heating phase in a heat transfer system 200. In situations above about 700° F. these species are likely to be vaporized. The produced effluent gas 210 from the peak heating reactor 100 is used to pre-heat the next reactor 220 scheduled to undergo its peak heating phase, as shown in FIG. 2. As the temperature of the effluent gas stream 210 cools, the higher boiling point hydrocarbons species will condense to produce two phase flow 230 in the reactor being pre-heated (e.g. 220).

After reaching a target temperature beyond which negligible hydrocarbon expulsion is achieved, for example between about 700° F. and about 900° F., or as may be determined for particular shale type, the peak heating phase for a reactor 100 is terminated. The reactor of now spent shale then undergoes a cooling phase. As used herein, during the "cooling phase" or the "cooling period," the spent shale is cooled by the same process used to heat the shale. Initial cooling of the spent shale reactor is achieved by injecting low grade steam into the base of the kettle. The steam initially exiting the spent shale reactor will be approximately the same temperature as the spent shale, declining to a temperature approaching that of the injected low grade steam as more steam is injected. The exiting steam may then be returned to a production facility where the heat energy may be recovered and reused.

An objective of the cooling phase is to reduce the temperature of the spent shale to enable its safe handling or safe solids transport when the reactor is emptied (e.g. via chute in FIG. 1). Once the cooling phase is completed, the reactor is emptied of its spent shale and recharged with raw shale rubble as part of that reactor's next heating and cooling cycle. A reactor will be emptied of its spent shale charge as a dry solid through the chute located in the base of the reactor, as wet shale slurry if water is used to recover additional heat from the spent shale, or in some instances a combination thereof. As discussed herein, in certain configurations and operations, each reactor may be recharged with shale by a conveyance system that empties the shale directly into a hatch in the cap of the reactor or through any conveyance into the interior of the rector, without limitation.

Figure 3:
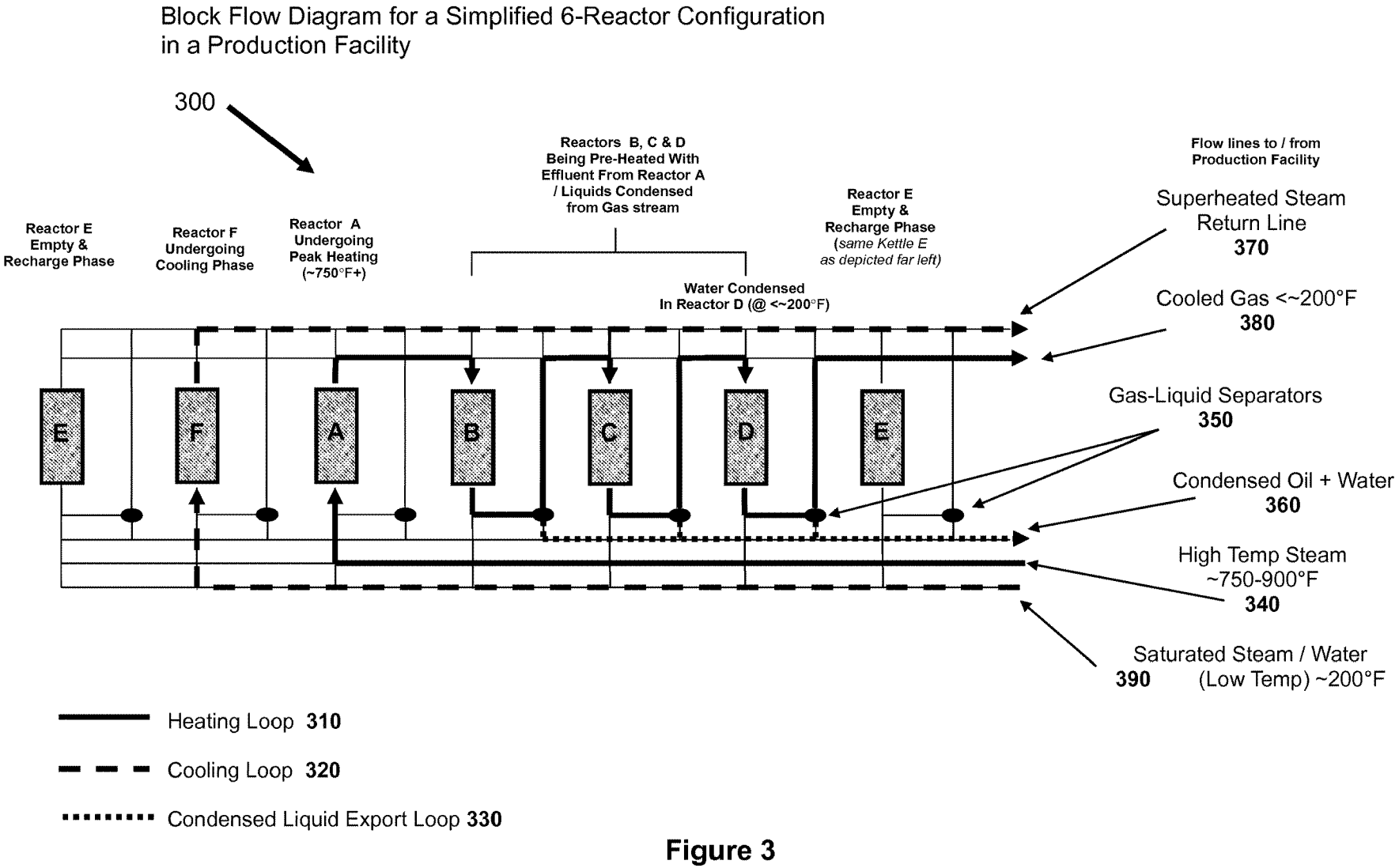
FIG. 3 schematically illustrates a batch process system and conduit configuration according to the disclosure.

Shown in FIG. 3, an exemplary block flow diagram for a single train, 6-reactor system 300 configuration may comprise all fluids circulating in one of three loops: heating loop 310, cooling loop 320, and condensed liquid export loop 330. The three loops form a thermal energy cascade, such that thermal energy from the highest temperature is directed to the lowest temperature loop. In this depiction, the Heating Loop 310 begins at a Production Facility sourcing steam 340 having a temperature which may vary from about 750° F. to about 900° F., to be used for heating. This steam 340 may be routed via manifold pipe work to a reactor undergoing its peak heating phase in Reactor A as illustrated. The effluent from the peak heating Reactor A may then be routed to an adjacent pre-heating phase as in Reactor B. In this configuration, Reactor B will be the next reactor to undergo its peak heating phase once peak heating of Reactor A is terminated or otherwise concluded. As the effluent cools, condensation of higher boiling point hydrocarbon species occurs in Reactor B. The fluids exiting Reactor B are routed to a gas-liquid separator 350. In this instance, the condensed oil may subsequently be sent to the production facility via a condensed liquid export loop 360. The remaining steam and hydrocarbon gas phase may be routed to Reactor C to pre-heat the reactor while also further cooling the effluent stream 360 and condensing additional oil.

In another configuration illustrated in FIG. 3, an additional Reactor D may be pre-heated, such that further cooling and condensation of the effluent stream 360 is accomplished. As much of the heat has been recovered from the gas phase as the steam passed through Reactors B and C, the gas temperature will fall below about 200° F. or about the boiling point of water during passage through Reactor D in the cooled gas stream 380. Alternatively the gas temperature will fall during the passage through the final pre-heating reactor in certain configurations. As may be understood, within the final pre-heating reactor, most of the water vapor will be substantially condensed from the gas phase along with some additional lower boiling point hydrocarbons. Further, this process may include enough reactors in a train to maximize recovery of the excess heat delivered to the peak heating phase, Reactor A as illustrated, while also condensing as much of the liquids as economically possible in condensed stream 360. The remaining gas delivered to the production facility may be a lean gas stream 380 compared to than the gas exiting Reactor A. Additionally, the remaining gas delivered to the production facility may be dryer than the gas exiting Reactor A, as the water vapor has been condensed from the vapor phase.

The pre-heating phases in Reactors B, C, and D are also intended to vaporize native free water content in the pore space of the shale, as well as any clay bound water present in rock fabric. When a reactor is preheated above about 200° F. or about the boiling point of water, the free and clay bound water may be separated and vaporized, and the water vapor may be then condensed in pre-heating reactors B, C, D with temperatures below about 200° F. or about the boiling point of water. The pre-heating phase reactors B, C, D therefore creates a fresh water supply in order to partially, if not completely, replenish the loss of water in downstream process facilities.

The cooling loop 320 in this example is accomplished by injecting saturated steam, water, or both into the base of Reactor F via the saturated stream line 390. As Reactor F had already undergone its peak heating phase prior to the commencement of the Peak Heating Phase for Reactor A, in order to facilitate emptying the reactor, the temperature of the reactor must be reduced. Thus it is possible to recover at least a portion of the substantial heat energy remaining in the spent shale and permit safe handling of the spent shale when the reactor is later emptied. The steam, water, or both injected into Reactor F may initially exit at an elevated temperature approaching that of the spent shale and then rapidly decline as heat is removed from Reactor F, eventually approaching the temperature of the injected steam, water, or both. It may be understood that use of water to quench a reactor may accelerate cooling due to the large amount of heat absorbed as required to vaporize the introduced water.

One element of the process is the injection of heating and cooling fluids at the base of base of hot reactors during both the peak heating phase Reactor A and cooling phase Reactor F. Without bottom injection, the shale particles, which are much softer at higher temperatures and may be devoid of their original kerogen content, would compact or compress in response to the weight of the shale thereinabove. Compaction would restrict flows paths for the injected fluids and reduce the rate at which heating and cooling fluids may be injected. The orientation of the fluid injection also may produce a pressure drop from the base to the top of the reactor to offset the weight of the overlying shale material. Thus, in a reactor as configured and described herein, the shale particles may be at least partially fluid-supported such that individual particles do not fully bear the weight of overlying shale particles. When operated in an expanded bed or fluidized bed modes achievable at higher gas phase velocity, the overburden weight of the particles would be reduced significantly, if not eliminated as particles are suspended in fluid. Bottom injection with a pressure drop equivalent to the overburden weight of the overlying shale bed may prevent agglomeration of the shale particles and make the heat transfer herein possible. Once cooled, these particles at least partially regain rigidity/strength to resist compaction.

While the block flow diagram of FIG. 3 shows three apparently separate process loops, it may be understood that the separate process loops may merge into a single continuous loop in a commercial implementation or development configuration. For example, the disposition of the high temperature steam returned 370 from the cooling loop 320 may source the steam for the heating loop 340, after additional heat is added to this stream. The high temperature water that returns to the production facility via the condensed liquid export loop 360 may be separated from the oil and then used to source the water needed for the cooling loop 320 as saturated steam and/or liquid phase water. By reducing the system to a single continuous loop whereby most heat transfer occurs in the reactors, the production facilities of the present configuration may be simplified.

Without limitation by theory, a simple process design provides a means of lowering capital costs and presents significant opportunity to achieve high thermal efficiency by recovering heat otherwise lost. More specifically, it may be understood that the present system and method are configured such that the reactors, facilities and materials handling equipment and components may be of a largely uniform design, readily fabricated, kept in inventory, and deployable in a modular system. Still further, by limiting temperature and pressure operating envelope of the reactors, the use of lower cost carbon steel is made possible in order to further reduce capital costs.

As disclosed hereinabove, the uncondensed hydrocarbons, hydrogen and other gases evolved from the pyrolysis reactions may provide significantly more fuel than needed to meet the heating and other energy needs of a larger system, project, or development according to this disclosure. Higher kerogen oil yield, for example that may exceed Fischer Assay, may be possible using aqueous/steam pyrolysis. Specifically, during the peak heating phase (e.g. in Reactor A), the rapid flow of steam through the void space between the shale particles should provide sufficient sweeping action to rapidly vaporize liquid hydrocarbons from the surface of shale particles to improve kerogen oil yield, therefrom. In the absence of this sweeping action, these liquids are subject to further cracking and deposition of increased amounts of unrecovered carbon (i.e. coke) on the shale or within the reactors themselves.

By limiting peak heating temperature of the shale rubble, the production of a higher yield (as compared with Fischer Assay) and higher API gravity oil content may be possible as compared with higher temperature combustion driven pyrolysis. By limiting peak heating temperature of the shale rubble to below about 900° F., the risk of decomposing carbonate constituents in the oil shale is likewise reduced. Still further, recognizing that heavy metals are often bound up in carbonates, the risk of releasing these contaminates is reduced according to the present method. The likelihood of fines entrained in the oil produced by the embodiments described herein will be reduced by comparison with ash introducing combustion processes. The condensing of produced oil in the gravel bed of a pre-heating reactor may also assist in the removal of particulate matter from the produced oil.

Additionally, although water is an integral part of the process by virtue of significant use in heating and cooling, the process recycles all the water used in a sealed system of vessels and pipe work. As excess fresh water may be produced from the shale, it may be possible for the process to be a net water producer in certain commercial applications and depending upon the water content of particular oil shales. The reported water content of oil shale deposits varies across the map, from about 1% to in excess of about 20% by weight (wt %). Utilizing an estimated water content ranging from about 2 wt % to about 5 wt % for most or average shale deposits, a significant excess supply of water is potentially generated by the process.

Still further, the present disclosure is configurable such that peak heat and cooling phases are operable in a matter of a few hours or few minutes. As may be understood, this duration may be at least partially dependent upon the scale of the installation being designed. The speed at which a spent reactor can be emptied and recharged may ultimately govern the production rate achievable by a single train of reactors. Standard engineering practices will operationally and economically optimize the production rate achievable by installations of varying size.

Depending upon the number of reactors used in a train and the number of trains used, a near constant production rate may be achieved. In a non-limiting example, as the production from a reactor declines when the hydrocarbon content of the shale charge is spent or recovered and its peak heating phase terminates, the production rate will be replenished by a subsequent peak heating phase reactor in a single train development scheme, for instance as demonstrated in FIG. 3. Further, in a multi-train development, a plurality peak heating reactors can be fired in a staggered fashion to maintain approximately a near constant rate of production. Further, utilizing the system and method disclosed herein, it may be possible to extend this configuration to other carbonaceous and hydrocarbon-based organic materials which may be favorably transformed by aqueous pyrolysis, such as but not limited to coal, lignite, biomass, plastics, used tires, refuse and other materials without limitation.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent . . . 95 percent, 96 percent, 97 percent, 98 percent, 99 percent, or 100 percent. Moreover, any numerical range defined by two R numbers as defined in the above is also specifically disclosed. Use of broader terms such as "comprises", "includes", and "having" should be understood to provide support for narrower terms such as "consisting of", "consisting essentially of", and "comprised substantially of". Accordingly, the scope of protection is not limited by the description set out above but is defined by the claims that follow, that scope including all equivalents of the subject matter of the claims. Each and every claim is incorporated as further disclosure into the specification, and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural or other details supplementary to the disclosure.

To further illustrate various exemplary embodiments of the present invention, the following examples are provided.

EXAMPLES

The following Example is meant to be illustrative and not-limiting to the overall disclosure of the system and method disclosed herein. In instances, the following Example 1, comprises illustrative calculations of the method and system:

| Volume of Shale in a Reactor & Amount Recoverable | | | |
|---|---|---|---|
| Reactor dimensions: | | | |
| Height of vessel | 40 | ft | |
| Radius of vessel | 10 | ft | |
| Volume of vessel | 12560 | $ft^3$ | |
| Void Volume in vessel | 0.4 | particle space est. | |
| Shale Volume in vessel | 7536 | $ft^3$ | |
| Density Sh | 2.3 | gm/cc | |
| Density Sh | 143.5 | $bl/ft^3$ | |
| WT. shale in vessel | 1081079.8 | lb | |
| WT. shale in vessel | 540.5 | ton | |
| Fischer Assay Yield | 25 | ga/tonLab derived est. (UT, WO) | |
| Vol oil produced | 13513.5 | gal | |
| Vol oil produced | 321.7 | bbl | |
| Heat Requirements for pyrolysis | | | |
| Shale Heat Capacity | 0.25 | BTU/lb-F | |
| BTU heat 1 lb shale from 50° F. to 750° F. | 175 | BTU | |
| BTU heat 1 ton shale from 50° F. to 750° F. | 350000 | BTU | |
| BTU to heat shale volume in kettle | 189188968.6 | BTU | 50° F. to 750° F. |
| MMBTU to heat shale volume in kettle | 189.2 | MMBTU | 50° F. to 750° F. |
| Heating requirement of peak heating vessel | 81.1 | MMBTU | 400° F. to 700° F. |
| Energy Content of Oil Shale | | | |
| Energy content of 1 ton oil shale | 5.34 | MMBTU/ton | |
| Energy content of shale in abovevessel | 2886.5 | MMBTU | |
| Heating Energy Applied/Energy Content of Shale | 6.55% | $H_2$; C1-C4, thermal energy. Poss. $H_2$ gas to upgrade oil | |
| Darcy Law Flow Rate of Steam (through peak heating vessel) | | | |
| Height of vessel | 40 | ft | |
| Crossectional area for flow (Pi × r^2) | 314.2 | $ft^2$ | |

-continued

| | | | |
|---|---|---|---|
| Pressure drop across vessel (1 psi × height) | 40 | psi | |
| Steam viscocity | 0.0244 | cp | Avg. ~750° F.; ~200 psi |
| Gravel Permeability | 100 | Darcy | |
| Resulting Flow Rate Q(CFD) | 8148596.72 | $ft^3$/day | |
| Resulting Flow rate Q (MMCFD) | 8.15 | MMCFD | |
| Density of steam | 0.329 | $lb/ft^3$ | Avg. ~700° F.; ~200 psi |
| Weight of steam circulated at above rate | 2680888.3 | lb/day | |
| Weight of steam/weight of shale | 2.48 | ratio/day | |
| Enthalpy of steam at inlet | 1476.59 | BTU/lb | ~900° F.; ~200 psi |
| Enthalpy of steam at outlet | 1374.58 | BTU/lb | ~700° F.; ~170 psi |
| Heat loss of steam (perfect heat transfer) | 102.01 | BTU/lb | ~900° F.-~700° F.) |
| Rate of BTU transfer (perfect heat transfer) | 273477417.7 | BTU/day | |
| MMBTU | 273.48 | MMBTU/day | |
| MMBTU required to heat shale (peak heating kettle) | 81.1 | MMBTU | |
| Days to heat shale | 0.30 | Days | |
| Hours to heat shale in vessel | 7 | Hrs | ~400° F.-~700° F. |
| Economics | | | |
| Daily oil production rate from single-train facility of above dimensions | 1085.2 | barrels | |
| Annual Production rate from single train facility of above dimensions | 396108 | barrels | |
| Revenue @ $80/bbl | $ 31.69 | MM | |
| 10 train facility | | | |
| Daily oil production rate from single-train facility of above dimensions | 10852 | barrels | |
| Annual Production rate from single train facility of above dimensions | 3961082 | barrels | |
| Revenue @ $80/bbl | $ 316.9 | MM | |
| Operating Costs | | | |
| Mining, materials handling & transport | $ 20 | bbl | |
| O&M | $ 10 | bbl | |
| Misc | $ 5 | bbl | |
| Total | $ 35 | | |
| Capital Cost | | | |
| All in cost | $ 200 | MM | |
| Oil Transport Cost | $ 15.0 | bbl | |
| Oil Price (inc. discount for kerorgen) | $ 75 | | |

Further, the Economics of operating a plant according to the disclosure herein may be shown herein in Example 2:

| 20 Yr Totals | | |
|---|---|---|
| Production Rate (BOPD)* | 10852 | BOPD |
| Production Rate (MMBO pa) | 79.22 | MMBO |
| Oil Price | $75 | flat |
| Revenue $ mm | $5,941.6 | mm |
| Capital Cost - $ mm | $200.0 | mm |
| Operating Cost - $ mm | $2,772.8 | mm |
| Oil Transport | $1188.3 | mm |
| Pre-tax CF | $1980.5 | mm |
| Discount factor (10%) | | |
| Discounted CF | $843.1 | mm |
| Undiscounted CF | | |
| IRR | 49% | |
| NPV0 | 1780.541 | |
| ROI | 8.90 | |
| Discounted CF @ 10% Discount Rate | | |
| NPV10 | 643.1 | |
| DROI | 3.22 | |

What is claimed is:

1. A method for recovering hydrocarbons from shale, comprising:

operating a plurality of reactors in a batch mode, wherein the reactors are configured for steam hydrolysis;

charging each reactor with shale particles;

cycling each reactor through phases, wherein the phases comprise:

a preheating phase;

a peak heating phase;

a cooling phase;

a recharge phase comprising removing spent shale particles from the reactor after the cooling phase and recharging the reactor with shale particles that have not undergone a peak heating phase and a cooling phase, wherein the spent shale particles are shale particles that have completed the peak heating phase and the cooling phase;

wherein the preheating phase comprises preheating the shale particles with vapor phase effluent produced during the peak heating phase;

wherein the peak heating phase comprises heating the shale particles from about 400° F. to about 900° F. using superheated steam, wherein the peak heating phase is configured to produce the vapor phase effluent, wherein the vapor phase effluent is configured to provide heat for the preheating phase;

wherein the cooling phase comprises cooling the shale particles that have completed the peak heating phase to recover heat energy from the spent shale particles, thereby cooling the spent shale particles before they are discharged from the reactor;

operating all of the plurality of reactors concurrently, such that no reactor of the plurality is in the same operating phase simultaneously;

introducing, from a production facility, superheated steam, with a temperature ranging from about 750° F. to 900° F., into a first reactor filled with shale particles that have been preheated to a temperature of about 400° F.;

heating the shale particles in the first reactor with the superheated steam to thermally crack kerogen within the shale particles, and vaporize liquid hydrocarbons that result from cracking of the kerogen, and vaporize water that is present in the shale particles, thereby producing the vapor phase effluent, wherein the vapor phase effluent comprises water vapor and hydrocarbon vapor;

recovering heat energy remaining in the vapor phase effluent produced in the first reactor upon completion of the first reactor's peak heating phase by transferring the heat energy from the vapor phase effluent in the first reactor to a second reactor that is operating in the preheating phase, wherein a temperature in the second reactor is less than the first reactor;

condensing the vapor phase effluent and producing a supply of fresh water in the second reactor; and after completing the peak heating phase of the first reactor and without an intervening phase in the first reactor:

cooling the spent shale particles in the first reactor by injecting water condensed from the vapor phase effluent into the first reactor, thereby producing steam by vaporizing the water contacting the spent shale particles, in the first reactor;

recovering the steam from the first reactor;

heating, in the production facility, the steam recovered from the first reactor to a temperature ranging from about 750° F. to about 900° F. to provide regenerated superheated steam for the peak heating phase;

injecting the regenerated superheated steam into a reactor that is operating in the peak heating phase; and replenishing water, due to a production of the superheated steam, in the production facility with the supply of fresh water.

2. The method of claim 1, wherein cycling each reactor comprises injecting water, steam, or both to heat the shale particles therein during a first portion of the cycling, and injecting water, steam, or both to cool the shale particles therein during a second portion of the cycling.

3. The method of claim 1, wherein cycling each reactor comprises injecting a portion of the hydrocarbons produced from at least one reactor into at least one other reactor during the at least one other reactor's preheating phase.

4. The method of claim 3, wherein injecting a portion of the hydrocarbons comprises injecting high-temperature hydrocarbon vapors produced from at least one reactor into at least one other reactor; wherein the hydrocarbon vapors cool and condense therein.

5. The method of claim 4, wherein the condensed hydrocarbons are utilized to remove particle fines entrained in a production stream.

6. The method of claim 1, wherein cycling each reactor comprises injecting high temperature heating and cooling fluids at the base of each reactor to prevent agglomeration of the shale particles;

wherein preventing agglomeration of the shale particles includes limiting the overburden weight of the shale on individual shale particles.

7. The method of claim 1, wherein cycling each reactor in the cooling phases comprises reducing the temperature of the shale particles below about 200° F.

8. The method of claim 1, wherein cycling each reactor in the recharge phase comprises removing the shale particles from each reactor by directing the shale particles through a chute into a solids handling device.

9. The method of claim 1, wherein transferring the heat energy to at least a second reactor operating in the preheating phase comprises establishing a thermal cascade.

10. The method of claim 9, wherein establishing a thermal cascade further comprises providing thermal communication between steam, water, and effluent from each reactor.

11. A method for recovering kerogen oil comprising:

loading a first reactor with rubblized shale;

loading a second reactor with rubblized shale;

heating the rubblized shale in the first reactor during a peak heating phase to a maximum temperature for the rubblized shale in the first reactor during the method with superheated steam sourced from a production facility, to thermally crack kerogen within the rubblized shale, and vaporize liquid hydrocarbons that result from cracking of the kerogen, and vaporize water that is present in the shale particles, thereby producing a vapor phase effluent, wherein the vapor phase effluent comprises water vapor and hydrocarbon vapor, wherein the superheated steam has a temperature ranging from about 750° F. to about 900° F.;

recovering heat energy from the vapor phase effluent produced in the first reactor;

transferring the heat energy recovered from the vapor phase effluent in the first reactor to the second reactor;

condensing the vapor phase effluent and producing a supply of fresh water in the second reactor;

collecting condensate from the second reactor, wherein the condensate comprises condensed vapor phase effluent, wherein the condensed vapor phase effluent comprises condensed water and condensed hydrocarbons;

heating the rubblized shale in the second reactor to a second peak heating temperature by injecting water, steam, or both into the second reactor at a location adjacent the bottom of the second reactor, wherein the second peak heating temperature is the maximum temperature for the rubblized shale in the second reactor during the method;

cooling the first reactor during a cooling phase, by injecting the condensed water from the condensate into the first reactor, thereby producing steam by vaporizing the condensed water contacting spent shale, in the first reactor, wherein the spent shale is shale that has completed the peak heating phase and the cooling phase;

recovering the steam from the first reactor;

heating, in the production facility, the steam recovered from the first reactor to a temperature ranging from about 750° F. to about 900° F. to produce regenerated superheated steam for the peak heating phase;

injecting the regenerated superheated steam into a reactor undergoing a peak heating phase;

wherein heating the first reactor to a first peak heating temperature comprises injecting the steam to create a pressure drop between the bottom of each reactor and the top of each reactor that is equivalent to an overburden weight of overlying rubblized shale when operating at a higher temperature;

recovering kerogen oil from the collected condensate; and replenishing water, due to a production of the superheated steam, in the production facility with the supply of fresh water.

12. The method of claim 11, further comprising operating a plurality of first and second reactors arranged in a thermal cascade.

13. The method of claim 11, wherein heating the first reactor to the first peak temperature comprises heating the first reactor to a temperature between about 750° F. and about 900° F.

14. The method of claim 13, wherein heating the second reactor to the preheating temperature with the hydrocarbon vapor from the first reactor, further comprises heating the second reactor to a temperature greater than about 400° F.

15. The method of claim 11, wherein heating the second reactor to the second peak temperature comprises heating the second reactor to a temperature between about 750° F. and about 900° F.

16. The method of claim 1, wherein the shale particles are heated to a maximum temperature achieved during the method during the peak heating stage.

17. The method of claim 11, wherein cooling the first reactor during the cooling phase occurs after heating the rubblized shale in the first reactor during the peak heating phase, without an intervening phase in the first reactor.

18. A method for recovering hydrocarbons from shale, comprising:

loading shale particles into a first reactor and a second reactor;

injecting superheated steam into the first reactor to heat the shale particles in the first reactor to a peak temperature for the shale particles in the first reactor during the method;

producing a vaporized effluent within the first reactor during the injecting;

flowing the vaporized effluent to the second reactor;

heating the shale particles in the second reactor with the vaporized effluent during the flowing;

cooling the shale particles in the first reactor immediately after the injecting; and removing the shale particles from the first reactor after the cooling.

19. The method of claim 18, wherein:

cooling the shale particles in the first reactor comprises flowing saturated steam through the first reactor; and the method comprises flowing steam from the first reactor to the second reactor after flowing the steam through the first reactor.

20. The method of claim 18, comprising:

injecting superheated steam into the second reactor after injecting the superheated steam into the first reactor, wherein injecting the superheated steam into the second reactor comprises heating the shale particles in the second reactor to a peak temperature for the shale particles in the second reactor during the method;

cooling the shale particles in the second reactor immediately after injecting superheated steam into the second reactor; and removing the shale particles from the second reactor after cooling the shale particles in the second reactor.

* * * * *